US005752537A

United States Patent [19]

Kranzler

[11] Patent Number: 5,752,537

[45] Date of Patent: May 19, 1998

[54] SUNSHADE/WINDBREAK/SHELTER

[76] Inventor: Bruce Kranzler, P.O. Box 66, Tomales, Calif. 94971

[21] Appl. No.: 642,405

[22] Filed: May 2, 1996

[51] Int. Cl.[6] ..... A45F 1/16

[52] U.S. Cl. ..... 135/128; 135/900; 135/909; 135/153; 135/154; 135/143; 135/117; 135/151; 135/132

[58] Field of Search ..... 135/87, 115, 117, 135/900, 901, 909, 121, 122, 127, 132, 133, 143, 151, 153, 154, 155

[56] References Cited

U.S. PATENT DOCUMENTS

| | | | |
|---|---|---|---|
| 225,372 | 3/1880 | Herbert | 135/909 X |
| 1,673,657 | 6/1928 | Woltjes . | |
| 1,713,425 | 5/1929 | Klyaich . | |
| 1,728,356 | 9/1929 | Morgan | 135/154 |
| 1,843,312 | 2/1932 | Ames | 135/154 |
| 1,912,425 | 6/1933 | Baumer . | |
| 2,134,879 | 11/1938 | Levy . | |
| 2,208,458 | 7/1940 | Julian . | |
| 2,499,897 | 3/1950 | Winquist | 135/143 X |
| 2,619,101 | 11/1952 | McGerry . | |
| 2,777,454 | 1/1957 | Kramer . | |
| 2,928,405 | 3/1960 | Lawson . | |
| 3,131,704 | 5/1964 | Shimon | 135/901 X |
| 3,434,483 | 3/1969 | Topham . | |
| 3,491,281 | 1/1970 | Reese | 135/900 X |
| 3,810,482 | 5/1974 | Beavers | 135/909 X |
| 3,893,466 | 7/1975 | Barker | 135/900 X |
| 3,941,140 | 3/1976 | Beavers | 135/909 X |
| 5,025,821 | 6/1991 | Page et al. | 135/151 X |
| 5,133,378 | 7/1992 | Tanasychuk | 135/153 X |

FOREIGN PATENT DOCUMENTS

| | | |
|---|---|---|
| 562430 | 5/1957 | Italy . |
| 2183267 | 6/1987 | United Kingdom . |

*Primary Examiner*—Wynn E. Wood

[57] ABSTRACT

A portable, collapsible, freestanding shelter for protection from sun, wind and precipitation. Shelter is comprised of four struts (8*a*, 8*b*, 9*a*, 9*b*) comprising two x elements juxtaposed and separated by releasably attached cross beams (14*a*, 14*b*, 14*c*). Rear adjustable stays (20*a*, 20*b*) strengthen and brace structure and, in combination with adjustable means (24*a*, 24*b*) used to lock position of x elements, provide a means of adjusting height of resulting frame. Shelter may be configured with visor arms (15*a*, 15*b*) attached to x element struts (8*a*, 9*a*). A cover (34) containing rigid rods or dowels (36*a*, 36*b*) on its front and rear edge is releasably attached to visor arms (15*a*, 15*b*) at front and pulled back over upper beams (14*a*, 14*b*) and held by adjustable cords (43*a*, 43*b*). Cover can be configured in a variety of ways to provide increasing or decreasing exposure to elements. (FIG. 4) Apparatus may be configured without beam 14a when front cover rod is in place thereby increasing head room. Referring to FIG. 7, frame and cover will support side covers, privacy curtain, insect barrier (26*a*, 26*b*). Visor arms (15*a*, 15*b*) may be folded away in strong wind and cover moved to cover back and top of frame and, in combination with side covers, it provides a wind barrier. Tethering or ground attachment is not necessary as shelter may simply be weighted. Further, shelter will configure to cover a prone person, a person in a low beach chair or an adult person in a standard sized chair. Shelter disassembles and rolls into a compact, lightweight bundle for storage or transport.

16 Claims, 6 Drawing Sheets

SUNSHADE/WINDBREAK/SHELTER

FIELD OF THE INVENTION

This invention relates to a portable, freestanding shelter and wind break to be used during sun bathing, recreational activities, outdoor spectator events and the like.

DESCRIPTION OF PRIOR ART

A variety of existing shelters address some of the problems regarding shade and wind however they all have the limitations of either not being effective, as with the shifting shadow of an umbrella, require tethering or staking which is problematic on a beach, or isolate the occupant in an enclosure as with a tent. The traditional umbrella is unstable in moderate wind, requires ground preparation to hold it upright and is not very effective at low sun angles. Numerous other attempts detailed in prior art references listed all fall short of the mark in meeting the needs of the sunbather, outdoor recreationalist or spectator.

The tent in U.S. Pat. No. 1,673,657 to W. F. J. Woltjes, 1928 Jun. 12, shelter in U.S. Pat. No. 1,713,439 to S. Klyaich, 1929 May 14 and beachshelter in U.S. Pat. No. 2,134,879 to S. S. Levy, 1936 Nov. 1 are basically tents staked and presumably tethered, they are not freestanding. These create obstructions on a crowded beach and are difficult to stake in sand. S. Kiyaich employs a fixed "X" brace that is used to keep two posts parallel S. S. Levy uses an "X" tether diagonally between top ends of vertical stakes that penetrate the ground, the "X" is used to support the top and keep poles from leaning outward. A quick examination reveals that none of these three prior art references is freestanding nor do they employ the "X" to any advantage other than as a substantially fixed brace.

Collapsible shelter in U.S. Pat. No. 1,912,425 to H. J. Baumer 1933 Jun. 6 uses a "lazy tong" to support a canvass. While incidentally variable in height the rectangle in plan view remains the same, there is a floor and the unit does not appear the be collapsible beyond the dimensions of the rectangle defined by its base and top. Beach accessory in U.S. Pat. No. 2,208,458 to C. E. Julian, 1940 Jul. 16 uses a tent approach to the "beach shelter" described. While variable in size to some degree it is fixed in height and staked into the ground, tethers, though not shown would appear to be necessary. The same is true of combined sunshade and wind guard in U.S. Pat. No. 2,619,101 to J. J. McGerry, 1951 Nov. 25.

Collapsible or portable lawn or beach umbrella in U.S. Pat. No. 2,777,454 to R Kramer, 1957 Jan. 15 provides for variable height and two positions for the awning. Again this is done by means of staking and presumably tethering. This would present difficulties in lawns which could be damaged, impervious surfaces and in sand if there were even a slight wind.

Italian patent 562,430 to Giuseppe Ermini and Figline Valdarno 1956 May 10 employs an "X" frame that supports a tent type structure that appears to be completely enclosed and deploys into one shape. While it would provide shade it would isolate the occupant from the surroundings and not have sufficient ventilation for comfort on a hot day. Again, the "X" is used as a one position brace in the structure. Portable shelter U.S. Pat. No. 2,928,405 to W. L. Lawson, 1957 Mar. 15 describes a shelter device that is reminiscent of Kramer (above) the unit raises and lowers a rectangular canvas off the ground and additionally provides for diagonally positioning canvass on four vertical poles. The means of staking would not be effective in sand without tethering and the shape would not be effective in blocking the sun at many times of the day. Further, there is no visor and no use of an "X" support structure in the design. Portable windbreaker U.S. Pat. No. 3,434,483 to E. H. Tophan, 1969 Mar. 25 describes a shelter that has an awning attached. While effective for wind the design requires staking into the ground, would not be effective for sun at most sun angles and attains one shape and height to accomplish it's task.

A framework for a shelter UK patent 2183267-A to Stewart Leonard Richardson, 1987 Jun. 3 uses a "lazy tong" framework to support a canvas. While employing an "X" structure it is used in connection with the "lazy tong" and is not adjustable. It is designed to attain a single shape, 'with a single motion ' and then be covered. While 'substantially open' in the front it would not have the visibility peripherally that my invention has nor would it be very stable in wind without tethering.

OBJECTS AND ADVANTAGES

Accordingly, besides the objects and advantages of the shelter described in my above patent, several objects and advantages of the present invention are:

a) to provide an effective barrier to sun, wind and precipitation;

b) accomplishing the above while keeping the user in maximum contact with the environment;

c) it is light weight and portable;

d) it is easy to erect even in strong wind;

e) it requires no ground attachment;

f) it may be easily weighted to provide stability;

g) it is completely free standing;

h) it may be reoriented while user is seated inside;

I) it has a unique ability to change shape keeping shadow close to user;

j) it may be adjusted to provide as much or as little shade as desired;

k) the frame is strengthened by wind;

l) the cover is replaceable;

m) the visor adjusts over broad range to be effective at all sun angles;

n) it may be widened for little additional cost to purchaser;

o) it does not expose fabric to ground in muddy or wet conditions;

p) it provides a uniquely unobstructed peripheral view;

q) requires no expensive tooling for manufacture.

Other objects and advantages of the invention not specifically enumerated will become apparent during the course of the following description with reference to the accompanying drawings wherein like numerals refer to like parts throughout.

DRAWING FIGURES

FIG. 7 Shows unit configured as in FIG. 6 with side covers adjusted for privacy i.e., dressing and the like.

REFERENCE NUMERALS IN DRAWINGS

| | |
|---|---|
| 8a., 8b. | Left (facing front) x element strut members |
| 9a., 9b. | Right (facing front) x element strut members |
| 10. | Upper rear guy releasable attachment means (on line) |
| 11. | "X" strut pivotal means, (bolt, rivet, etc.) |
| 13. | Visor support arm pivotal means (bolt, rivet, etc.) |
| 14a, 14b, 14c. | Horizontal beam members of frame |
| 15a, 15b | Visor support arms |
| 16a., 16b. | Lower guy line attachment means (screw in eye or hole in lower, rear struts) |
| 16c., 16d. | Upper guy line Attachment means on strut 8b, 9b or beam 14b (screw-in eye on strut or attachment to extension of 18 in FIG. 12) |
| 17. | Releasable connection on "X" frame strut member (dowel hole) |
| 18. | Releasable connection horizontal beam member (dowel pin) |
| 19. | Visor dowel releasable connection (slot) |
| 20a., 20b. | Rear adjustable guy line braces |
| 21. | Means of releasing front guy line (cord lock) |
| 22. | Rear adjustable guy line adjustment means (cord lock) |
| 23. | Front guy line |
| 24a, 24b | Base cord or strap left and right |
| 25. | Means of holding position on base cords |
| 26a, 26b. | Side covers |
| 29a, 29b. | Means of attaching side covers (Buttons, snaps, hook and loop tape) 2 halves |
| 30a., 30b. | short dowel pins to allow removal of front horizontal strut in highest position right and left strut ends |
| 32. | Floor, detachable, fastens to 14c. |
| 33. | Upper front guy line means of attachment at 8a, 9a strut ends |
| 34. | Cover |
| 35. | Attachment means at ends of front and rear cover rods |
| 36a. | Removable long cover rod in pocket at front edge of awning (visor) |
| 36b. | Removable long cover rod in pocket at rear |
| 39. | Floor means of attachment to 14c. |

-continued

| | |
|---|---|
| 40a | Dowel pocket (front) |
| 40c | Dowel pocket (rear) |
| 41. | Ties on bottom of side covers |
| 42. | Storage bag |
| 43 | Elastic cord (to tension cover) |
| 44a, 44b. | Means for releasably attaching elastic cord to long cover rod (hook, bungie type) |
| 45a, 45b. | Means of adjusting length of elastic cord (Cord lock) Confined by lower screw-in eye |
| 47. | Adjustable means for supporting side covers |

DESCRIPTION

The Frame

Figure 1:
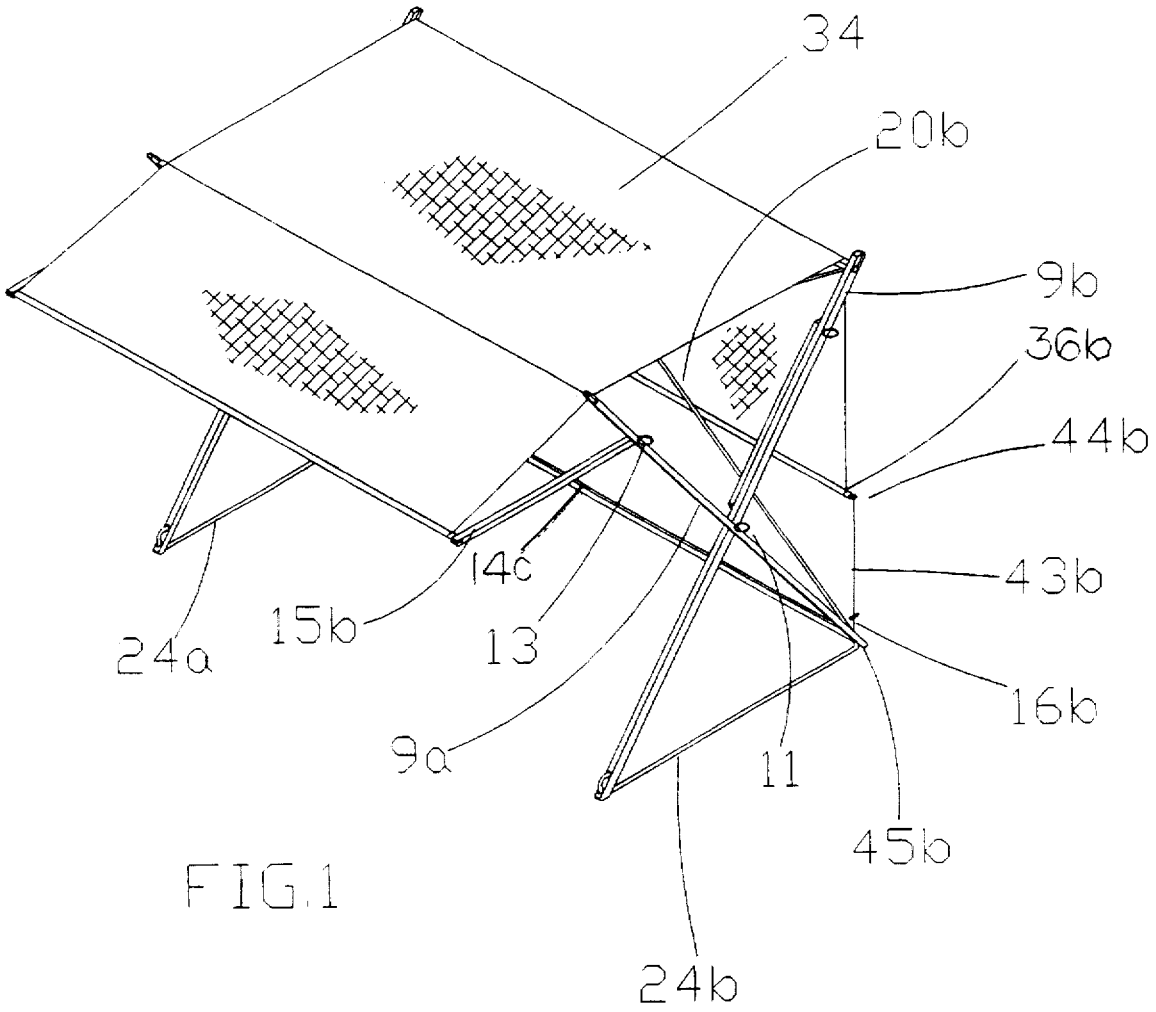
FIG. 1 Shows apparatus in an assembled state and in its mid position for low beach chair in one embodiment.
Figure 2:
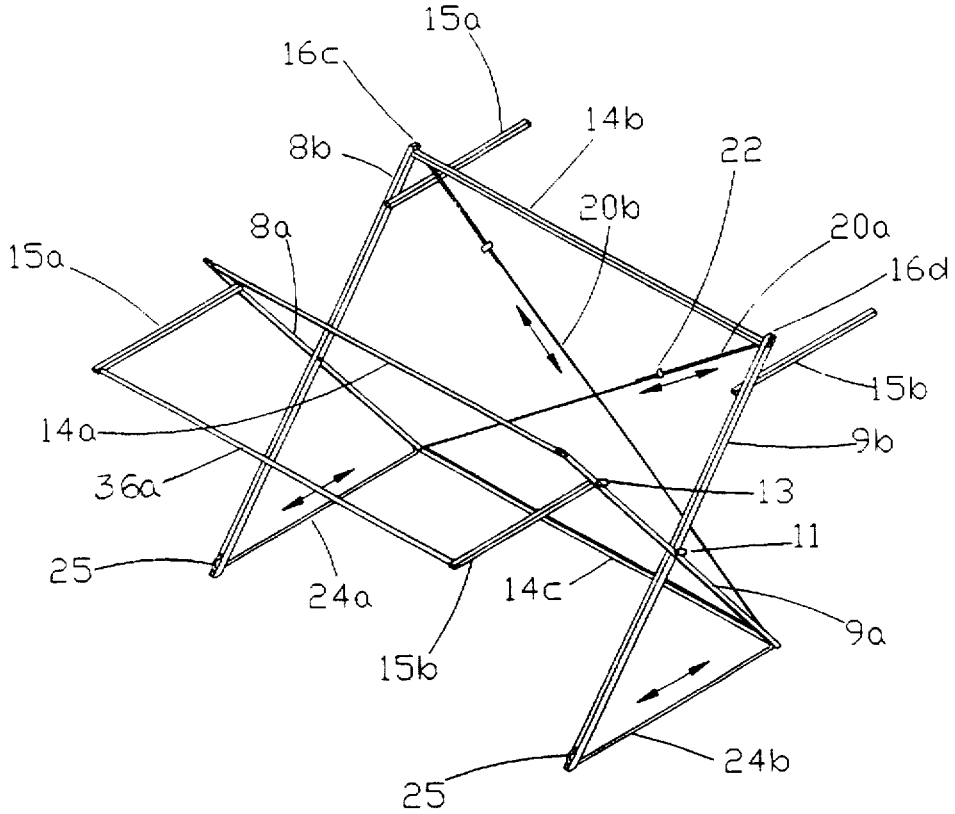
FIG. 2 Shows framework of structure with the various cords that hold it together and allow for adjustments.
Figure 8:
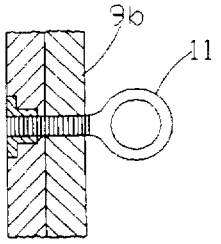
FIG. 8 Shows (detail) pivotal connection to struts that form x element sides.
Figure 10:
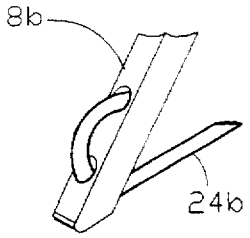
FIG. 10 Shows (detail) base cord attachment to strut x element leg.
Figure 11:
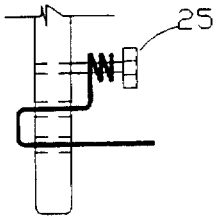
FIG. 11 Shows (detail) a means of locking position (length) of base cord.
Figure 12:
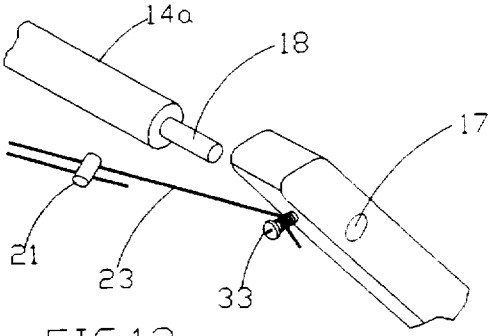
FIG. 12 Shows (detail) a means of releasable attachment and adjustable guying together of cross beams and x elements of framework FIG. 13 Shows (detail) attachment of cover and cover rod to visor arms.

Referring to FIG. 1 and FIG. 2 throughout. Apparatus is comprised of four struts 8*a*/8*b* and 9*a*/9*b* assembled into two x elements by pivotal means in FIG. 8, a bolt, rivet or friction device 11 at or near mid point of each. In FIG. 12 horizontal beams 14*a*, 14*b* and 14*c* are releasably attached at or near strut ends of apposed x elements 8*a*/8*b* and 9*a*/9*c* such that they connect the two x elements and create a box like framework. The rear of the structure has two beams and the front has one beam in this embodiment. Referring to FIG. 10 and FIG. 11, x elements are held to a predetermined position by base cords 24*a* and 24*b* which are in turn locked by means 25 fastened at ends of struts 8*a*/8*b* and 9*a*/9*b*. Guy lines 20*a* and 20*b* are attached diagonally corner to corner at rear of structure and fitted with a cord lock or other adjustable means 22. Their purpose is to compress beams between x assemblies, strengthen the structure and provide an adjustable counter force to locked base cords 24*a* and 24*b*. Further, they prevent x element struts 8*a*/8*b* and 9*a*/9*b* from rotating in either direction.

Figure 4:
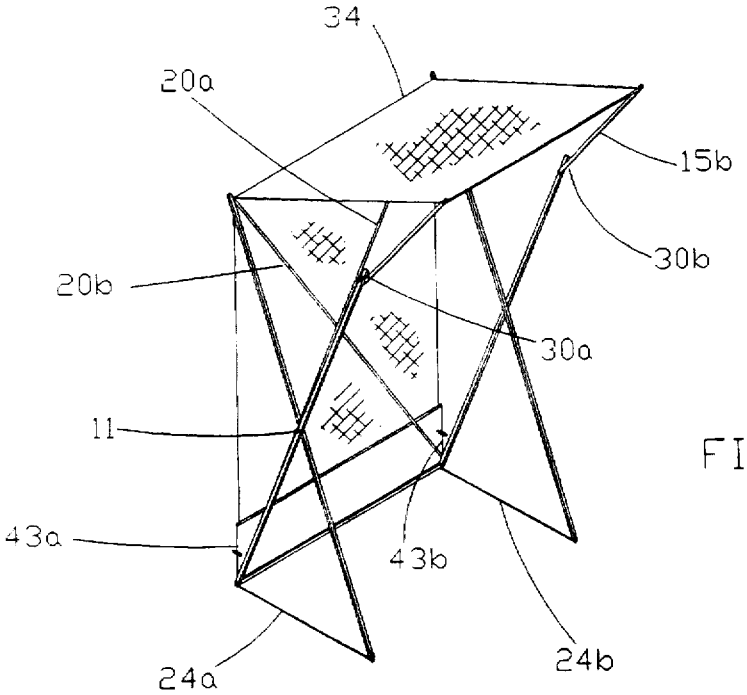
FIG. 4 Shows unit in highest position without front frame beam, for standard height chair in one embodiment.
Figure 6:
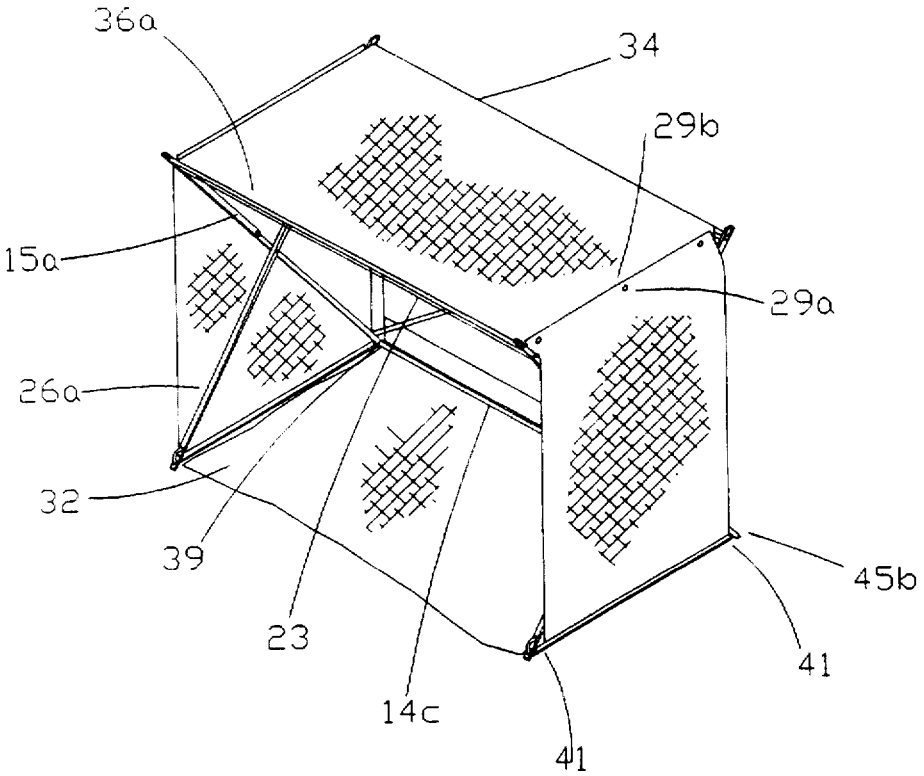
FIG. 6 Shows apparatus with visor arms folded away and front cover rod fastened fastened under front stay, configured for strong wind with optional floor and side covers.

The structure is now a freestanding frame that may be easily readjusted to different heights by changing the length of base cords 24*a* and 24*b* in conjunction with guy lines 20*a* and 20*b*. In FIG. 12, the frame is further strengthened by addition of a third guy line 23 parallel to the front beam that is tensioned by means 21 to hold beam 14*a* in place. Referring to FIG. 12 and FIG. 6, guy line 23 also provides a means of holding cover rod in embodiment shown. Further, it provides a means of releasing and removing beam 14*a* as shown in FIG. 4.

Referring to FIG. 1 and FIG. 2 the frame is fitted with one or two sets of visor support arms 15*a* and 15*b* by pivotal connection 13. These support front cover rod, FIG. 13, 36*a* when front portion of cover 34 is used as a visor. Addition of Rear visor support arms may be used to extend cover 34 horizontally from the back of the structure. (FIG. 1, shown folded away)

Figure 15:
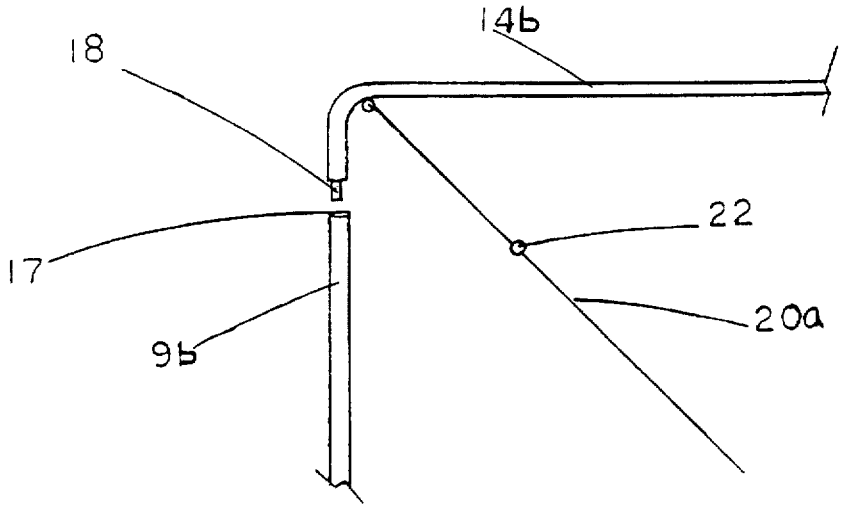
FIG. 15 shows (detail sketch) alternate means of attaching beam to X elements formed by 8*a*, 8*b*, 9*a*, 9*b*.

Referring to sketch, FIG. 15 In another embodiment beams 14*a*, 14*b*, and/or 14*c*, all or a combination of the above would have right angle bends at their ends. The means of attachment to struts 8*a*, 8*b*, 9*a*, 9*b* would be at the ends of right angle returns on beams which would be pressed or slid onto or otherwise fastened to strut ends of 8*a*, 8*a*, 8*b*, 8*c*. This would allow for shorter struts to be used for x strut elements. In this embodiment beams 14*a*, 14*b*, 14*c* would provide a hinge or rigid right angle bend before joining to strut end 8*a*, 8*b*, 9*a*, 9*b*. Rear guys 20*a* and 20*b* would attach to beams 14*b* and 14*c* and provide sheer strength and a means of adjusting and holding position of x elements 8*a*, 8*b*, 9*a*, 9*b*. In this embodiment rear guy lines would remain attached to cross beams for disassembly of the frame. The x element struts 8*a*, 8*b* and 9*a*, 9*b*, could be reduced to a hub which would receive right angle extensions from cross beams 14*a*, 14*b* and 14*c*.

Figure 16:
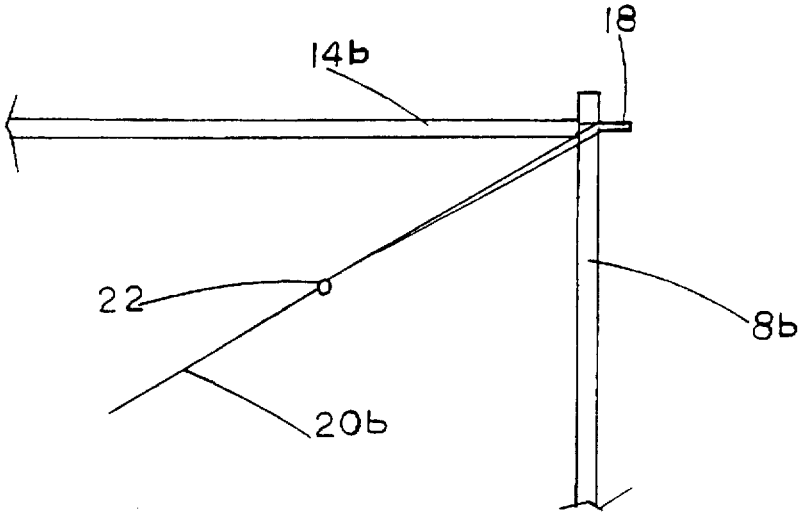
FIG. 16 shows (detail sketch) another preferred embodiment of attachment of cross beam to x elements 8*a*, 8*b*, 9*a*, 9*b*.

FIG. 16 shows an alternate preferred embodiment of the beam connection to the x element strut ends. This variation employs a longer pin or dowel 18 that projects beyond the strut side 8*b*. This projection is used as the attachment point for the guy lines 20*a* and 20*b*. Either a loop formed by the cord lock 22 as shown or a flexible material with a hole the same diameter as the dowel pin are anticipated here. The attachment of the guy line serves the additional purpose of retaining the strut end on the beam at this releasable joint.

Cover

Referring to FIGS. 1, 4, 6, and 7, The cover 34 is a rectangular piece of weather moderating fabric effective for shade, rain, or wind. Further referring to FIG. 13 Cover 34 is rectangular in shape and is fitted with one or more long rods used to support the front and rear edge of the fabric and attach it to the frame at visor arm 15*a*, 15*b*, and at the rear by cover cords 43*a* and 43*b*.

Figure 9:
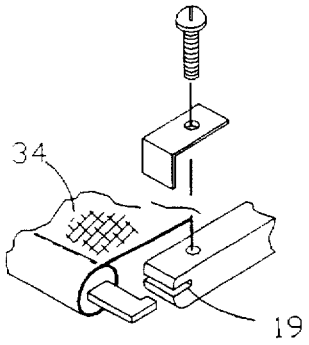
FIG. 9 Shows (detail) optional roller blind attachment common to visor arms and x element strut ends to allow various mounting positions.

Further referring to FIG. 9 a preferred embodiment uses a roller blind to deploy cover. In This embodiment the roller blind would replace Rod 36*a* and have releasable means 35 incorporated into the roller blind structure. Attachment means, represented by slot 19 could be at visor ends or at the x element strut ends 8*a*, 9*a* or 8*b*, 9*b*. Roller blind 34/ 36*a* could be mounted on the front and pulled back toward the rear of the structure. Roller blind 34/ 36*b* could be mounted at rear of structure and be pulled forward. In this embodiment the tensioning of cover 34 would be provided by the roller blind spring and eliminate the need for elastic cords 43*a* and 43*b*.

From the description above, a number of advantages of my shelter become evident:

(a) Frame may be constructed of any straight, rigid material suitable for outdoor use.

(b) Frame may be manufactured with unsophisticated tooling.

(c) Frame is easily assembled even in windy conditions.

(e) Cover is easily manipulated in windy conditions because the rod or rods are rigid the fabric wont flap uncontrollably.

(f) Cover will be easily replaceable having both advantages in utility and marketing.

(g) Frame may be shipped separately and fabric may be inventoried for selection without a like inventory of frames.

(e) Fabric does not need to come in contact with the ground.

(f) Dimensions may be altered easily to accommodate varying uses.

(g) Frame may be configured in a variety of ways to accommodate different uses.

(h) structure is very strong for its weight.

(i) Frame is easily disassembled.

(j) Frame is easily transported.

DESCRIPTION OF THE PREFERRED EMBODIMENTS

The shelter is used for outdoor activities where protection from sun, wind and rain is desired. Apparatus provides protection while allowing maximum contact with the environment unlike that provided by a tent or umbrella. The shelter does not enclose like a tent, allows for a wide selection of positions and side cover options and is stable in windy weather unlike an umbrella. It may be stabilized further by simply weighting frame or base cords thereby eliminating the need for ground attachment. Shelter may be used in wet or muddy areas without soiling fabric. It is easily collapsed and transported.

Figure 3:
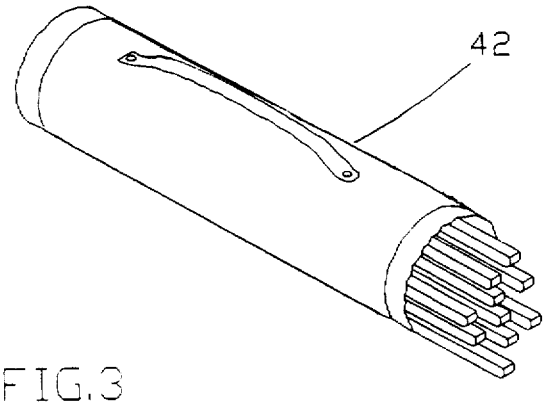
FIG. 3 Shows apparatus in a disassembled state and packed for storage or transport.

Referring to FIG. 2 one removes folded shelter from storage bag 42 in FIG. 3 and separates the cross beams 14*a*, 14*b* and 14*c* from two preassembled x elements 8*a*, 8*b* and 9*a* 9*b*. X elements 8*ab* and 9*ab* are spread apart from a substantially parallel, folded position whereby struts form wider, predetermined angles defined by the length of base cords 24*a* and 24*b*. X elements are placed face to face, one on top of the other and oriented so that visor arms 15*a* and 15*b* are opposite one another.

Referring to FIG. 12 beams 14*a*, 14*b* and 14*c* are slideably fitted into dowel holes at or near the ends of x element struts of the bottom x element. Top x element is raised and placed on like dowel pins at opposite ends of 14*a*, 14*b* and 14*c*. A cuboidal structure having one empty corner is thereby formed. Rear guy lines 20*a* and 20*b* are fastened diagonally between x strut ends at rear opposite visor arms 15*a* and 15*b* and substantially in plane with two beams 14*b* and 14*c*. Cord locks 22 are then tensioned strengthening structure at rear and holding tension on base cords 24*a* and 24*b* preventing them from rotating back toward their original position when folded. Frame is thereby strengthened and frame is tipped onto its legs with base cords 24*a* and 24*b* nearest the ground. Referring to FIG. 2 visor arms 15*a* and 15*b* are rotated out from their storage position parallel to upper x element strut ends.

Apparatus configured for Low Beach Chair (Mid Position)

Figure 13:
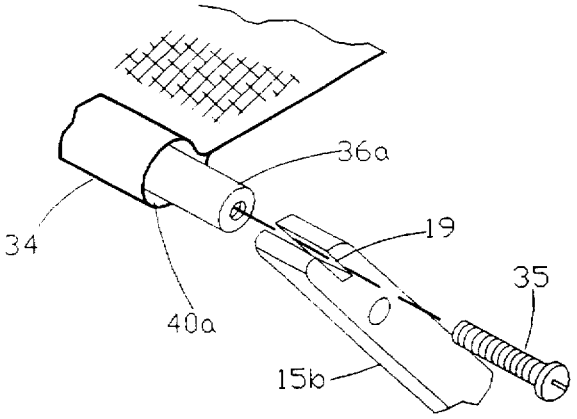

Referring to FIG. 1, FIG. 2 and FIG. 13. With frame assembled and adjusted as in FIG. 2 Rods 36*a* and 36*b* are inserted in end pockets 40*a* and 40*c* at opposite ends of cover 34. Cover 34 is placed over frame with rod 36*a* pocket 40*a* toward front and between visor arms 15*a*, 15*b*. Rod 36*a* in FIG. 13 is attached to visor arm 15*a*, 15*b* by large headed screws 35 in ends of rod 36*a* slideably placed in end slots 19 of arm 15*a*, 15*b*. Rear of cover, rod 36*b*/pocket 40*c*, is draped over beam 14*b*. Hooks 44*a*, 44*b* at end of elastic cord 43*a*, 43*b* are attached to rod 36*b* at large headed screws 38. Cover is tensioned over frame by shortening length of elastic cords 43*a*, 43*b* with cord locks 45*a*, 45*b* confined by screw in eyes 16*a*, 16*b*. Cover 34 is tensioned against visor arms 15*a*, 15*b* such that the elastic cord allows pivotal motion of said visor arms while keeping cover taught. Visor 15*a*, 15*b* position is held by cover tension and friction at visor pivotal attachment 13.

Options for Apparatus Shown in Low Beach Chair Position

Figure 7:
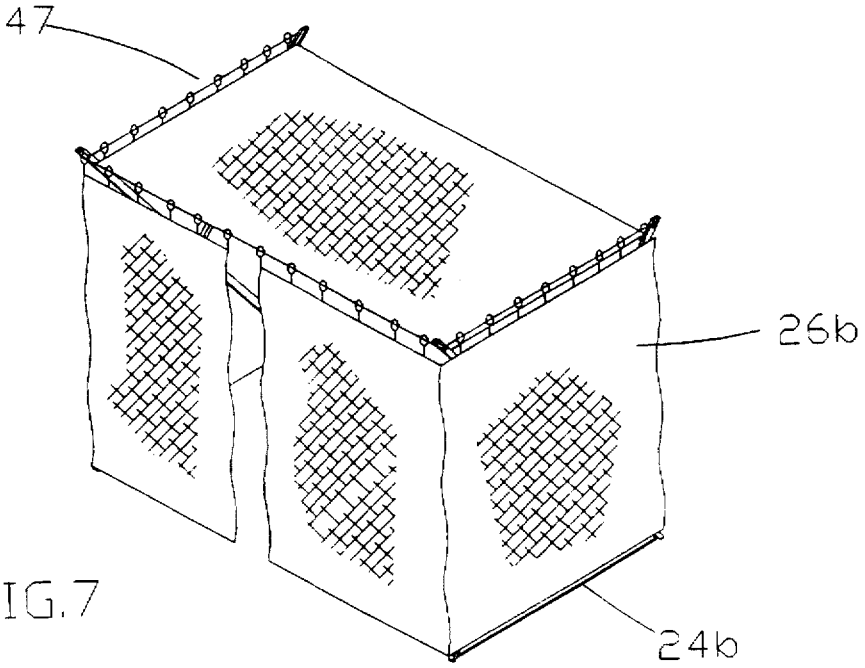
Figure 14:
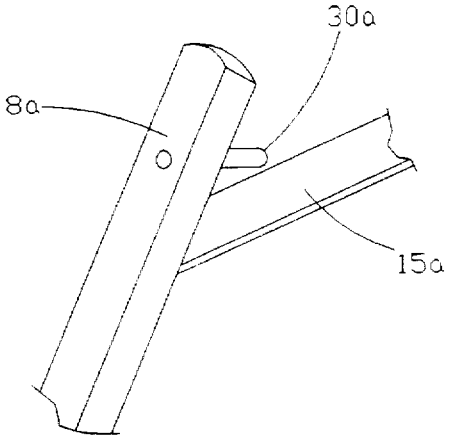
FIG. 14 Shows (detail) short dowel pins for restricting rotation of visor arms when front cross beam is removed (as in FIG. 4)

Apparatus as shown in FIG. 1, FIG. 6 and FIG. 7 will accommodate a variety of options. FIG. 6 shows side covers 26*a*, 26*b*. Side covers attach to the edges of cover 34 by releasable means 29*a*, 29*b* buttons, snaps, or hook and loop fasteners. Side covers may also hang from adjustable cord 47. Further, covers may be made of opaque canvas, insect netting or light diffusing material. FIG. 14 shows apparatus with removable floor 32 releasably attached to beam 14*c* by means, ties, buttons snaps, hook and loop 39 in FIG. 14.

Apparatus as Wind Break

Referring to FIG. 1, FIG. 2 and FIG. 6 Apparatus can be configured for strong wind. Front dowel 36*a* is released from slot 19 on visor support arms 15*a*, 15*b* which are folded away. Dowel 36*a* is repositioned under front guy 23, cover 34 is shifted back. Elastic cords 43*a*, 43*b* are tightened with cord locks 45*a*, 45*b*, rear is now substantially closed. Side covers are positioned in commonly centered attachment means 29a and 29b then tied to lower x element strut ends 8a, 8b, 9a, 9b. Weight may be applied to base cords 24a, 24b or beam 14c by using storage bag 42 filled with sand or any effective means. Apparatus may also be tethered to center of x elements 8, 9 if eye bolts are used as pivotal means II. Apparatus thereby provides three sided enclosure able to withstand strong wind. Rear guys 20a, 20b provide support for top/back 34 and tighten with wind pressure, strengthening frame.

Apparatus Configured for Prone Position

Figure 5:
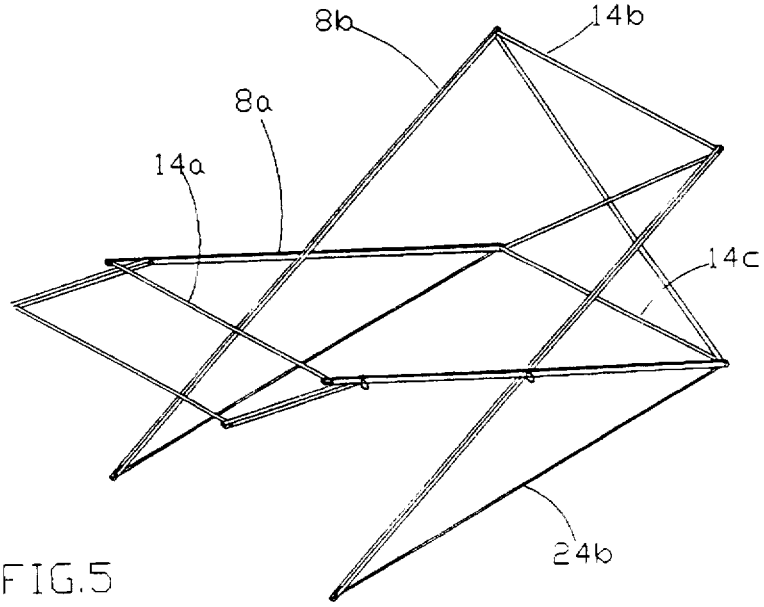
FIG. 5 Shows framework of structure in lowest position for prone occupant in one embodiment.

Referring to FIG. 1, and FIG. 5 Starting with apparatus configured as in FIG. 1 Base cord clamping means 25 are released allowing base cords 24a, 24b to be lengthened, 25a, 25b are re-locked. Cover 34 is thereby lowered toward ground. Elastic cords 43a, 43b are re-tensioned with cord lock 45a, 45b tightening cover 34 on frame and visor support arms 15a, 15b. Guys lines 20a, 20b are retightened thereby strengthening the frame. FIG. 11 Cover 34 is now closer to prone occupant and substantially longer relative to the ground.

Apparatus Configured for Standard Chair Height

Referring to FIG. 1, FIG. 2 and FIG. 4. Starting with apparatus as shown in FIG. 1 Rear guy lines 20a, 20b are loosened substantially. Elastic cords 43a, 43b are loosened. Base cord clamping means 25 are released, base cords 24a, 24b are shortened, clamps 25 are retightened. Guy lines 20a, 20b are retightened strengthening frame. Front guy line 23 in expanded view FIG. 12 is loosened by means 21 and removed from hole 17, front beam 14a is removed. Referring to FIG. 14 dowel pins 30a and 30b project into path of visor arms 15a, 15b preventing visor arms from rotating beyond position illustrated Elastic cords 43a, 43b are re-tensioned thereby pulling visor support arms 15a, 15b into contact with dowel pins 30a, 30b. Cover is held taught by elastic cords 43 and 43b. Apparatus is in position illustrated in FIG. 4. Front support for frame is provided by long rod 36a in cover pocket 40a captured in visor support arms 15a and 15b slots 19.

Another means of quickly accommodating higher chairs is to turn apparatus as shown in FIG. 5 "prone position", on its "back" as defined by guy lines 20a, 20b. Back now becomes the base. Apparatus provides protection to rear of occupant, visor provides limited shade above.

Apparatus Ready for Storage or Transport.

FIG. 3 shows frame and cover disassembled, folded and rolled to fit in storage bag 42.

SUMMARY

Accordingly, the reader will see that the shelter apparatus of this invention is unique and very effective at providing shelter from sun, wind and precipitation. Further, it solves many of the problems inherent in traditional sheltering devices;

- it permits one to erect a freestanding structure without a floor or sides;
- it provides a unique, unobstructed peripheral view to front;
- it requires no ground attachment;
- it may be weighted on the frame and base cord in strong wind;
- it is strengthened by strong wind;
- top cover may be shortened or lengthened;
- it will support side covers if desired;
- may be reoriented without occupant moving from seated position;
- visor allows a wide range of control of shading at low sun angles;
- it configures into a variety of shapes to accommodate various activities;
- cover and frame are separate thereby allowing a variety of covers to be inventoried;
- it is easily erected and taken down;
- it is easily manufactured without sophisticated tooling;
- it is light weight.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

I claim:

1. A portable shelter embodying a front, a rear and two side sections, each said side section including two struts pivotally attached in the middle forming an x element, each said x element having four ends, said x element further including a face being in plane with four said ends when the x element is in an extended condition, a means of locking pivotal rotation of said struts within said x element, two said x elements being placed said face to said face a predetermined distance apart and releasably connected to the ends of at least two parallel cross beams, one above the other, disposed between four opposite x element ends defining the rear of the shelter, at least two adjustable guy lines with length adjusting means coplanar with said beams but crossing diagonally and attaching to the same four said x element ends at the rear of said shelter, whereby, tension on said guy lines via said length adjusting means compresses said beams between said opposite x element ends, diagonal force of the rear stays transfers into rotational force between the struts in the side section x elements of frame and binds against said means of locking x element strut rotation.

2. The portable shelter in claim 1 wherein said means of locking rotation of said struts within said x elements is a flexible cord, or strap having length adjusting means wherein one end of each said strap is connected to a side section said x element end that is also attached to said rear guy line the other end of each said strap carrying forward and releasably attaching to the end of the other strut within the pair that is not directly attached to said rear guy lines such that when said cord is reduced in length it correspondingly restricts free rotational movement of struts within the side section x elements in one direction, whereby, tension on the rear guy lines via length adjusting means compresses beams between said x element ends, the diagonal pull transfers to rotational counter-force to said strap used for restricting rotation on side section x element struts and binds each side section x element's rotation in the direction of its unrestrained free movement thereby creating a rigid frame that may be easily adjusted to various heights by means of said guy lines in concert with said cord having length adjusting means.

3. The portable for the shelter in claim 2 further including a cross beam substantially the same length as said rear beams at the front section of the structure releasably connected to upper front said x element ends such that said beam is substantially parallel to said rear section cross beams thereby maintaining a predetermined distance at the front section of the structure and strengthening the structure.

4. The portable shelter in claim 3 further including an adjustable, releasable front stay attached at one front upper said x element strut end and crossing parallel to said beam and releasably attaching to the opposed upper x element strut end.

5. The portable shelter in claim 4 further including a plurality of adjustable, flexible cover cords of a predetermined length attached substantially near the lower, rear x element strut ends wherein, said cords have releasable means of attachment disposed at one end thereof and a means of adjusting the length of said cord.

6. The portable shelter in claim 5 further including a weather moderating fabric cover, having a front and a rear, a substantially rectangular shape, said cover further including two pockets disposed along the front and rear edges and perpendicular to the sides thereof, one or more rods contained in said pockets, wherein said rods having releasable means of attachment disposed at both ends, said means of attachment project from the pockets, whereby, the front of the cover is placed over said front beam, said front of said cover is secured to said front beam by releasable means, rear of the cover containing rear said rod is pulled over said upper, rear beam and secured by releasable means to said cords attached to lower, rear x element strut ends, thereby creating a cuboidal structure covered above and at the rear.

7. The portable shelter in claim 4 further including at least two visor arms one end being pivotally attached near the upper front side section x element strut end, said visor arms having releasable attachment means disposed at the free ends wherein said visor arms rotate in substantially the same plane as x element strut rotation.

8. Portable shelter in claim 7 further including a weather moderating fabric cover wherein said cover, has a front and a rear, a substantially rectangular shape, two pockets disposed along the front and rear edges and perpendicular to the sides thereof, one or more rods contained in said pockets, said rods having releasable means of attachment disposed at both ends, said means of attachment project from said pockets, front of said cover is placed over said front beam, said front rod is releasably attached to said visor arms free ends by said releasable means, rear of the cover containing said rod is pulled back over the upper rear beam and secured to said cover cords, whereby cover is secured to frame at the front and rear, said cover fastened to said visor arms cantilevers front of cover beyond the side section x element strut end, the visor arms can be moved up or down while cover is held in tension by rear said cover cords.

9. A portable, collapsible, freestanding shelter consisting of a frame having a front, a rear and two side sections each said side section further including a strut with a middle and two ends, a pair of said struts pivotally attached substantially in the middle forming a scissor or x element, each said x element having a face substantially coplanar with said ends when said x element is in an extended condition, a strap, cord or line having adjustable means attached to one said x element strut end and releasably attached to an end of the other strut within the pair such that the length of said line restricts the rotation of said struts in one direction, wherein x elements are oriented said face to said face, a front beam is releasably attached between and perpendicular to the faces of the upper, front x element strut ends, a plurality of rear beams are releasably attached between upper and lower, rear x element strut ends and substantially parallel to said front beam, a plurality of adjustable stays releasably attach at the rear of the shelter and cross diagonally, corner to corner in substantially the same plane as said rear beams from said x element strut end to the opposite x element strut end such that adjustable stays are tensioned against diagonally opposite rear x element strut ends, the rear beams are compressed between the x element strut ends, the rear, adjustable stays provide lateral bracing, tensioning the rear stays applies force counter to said adjustable strap, cord or line used for restricting the x element strut rotation, two visor arms pivotally attached substantially near each upper, front said x element strut end such that said visor arm rotates substantially parallel to the x element strut rotation, a releasable means of attachment at a free end of said arm, two adjustable, cords attached substantially near lower, rear x element strut ends, each said adjustable cord having releasable means of attachment, disposed on the free end, whereby the rear adjustable stays operate in concert with the adjustable cord line or strap used for fixing the rotation of the struts within the x elements to raise, lower, lengthen or shorten the frame, two said visor arms and two elastic cords provide releasable means of attachment for a cover.

10. The portable shelter in claim 9 further including a weather moderating fabric cover wherein said cover, has a front and a rear, a substantially rectangular shape, a pocket disposed at each end and perpendicular to the sides thereof, one or more rods contained in said pockets, said rods having releasable means of attachment disposed at both ends, said means of attachment project from said pockets, wherein the front of said cover is attached to said visor arms by said releasable means, the rear of the cover is pulled over the upper, rear beam and secured by releasable means to said elastic cords attached to lower, rear x element strut ends, whereby, tension may be maintained on the cover through various positions of the said frame by said adjustable means on elastic cords, elastic cords hold the cantilevered cover taught, when the arms, attached to the upper, front x element strut ends are rotated at said pivotal attachment.

11. The portable shelter of claim 10 further including side covers releasably attached at the lower ends of said x element strut ends and on the perimeter edge of said sides of the cover.

12. The portable shelter of claim 10 further including a floor attached by releasable means to the said lower, rear beam.

13. The portable shelter of claim 10 further including a side cover enclosing all sides of the structure wherein said side cover attaches to top cover perimeter edges by releasable means.

14. The portable, shelter in claim 9 further including, a cover rolled on a spring roller blind releasably attached to said visor arms such that length of said cover is maintained by said adjustable elastic cord, tension on cover is maintained by said spring roller blind.

15. A portable shelter embodying a front, a rear and two side sections, each said side section being comprised of two struts pivotal connected substantially at their centers forming an x element, each said x element having four ends, said ends having releasable means for attachment, the x elements further including a face being in plane with four said ends when the x element is in an extended condition, a line, a cord or strap with length adjusting means attached near the end of one said strut and attaching by releasable means near said end of other strut in each pair such that the cord in the side section x elements adjustably confines rotational movement of said struts, wherein, said cords are held to substantially the same length by said length adjusting means in each side section x element, said portable shelter further including at least two beams both said beams having right angle turns disposed at each end placed substantially parallel one said beam above the other beam, said beams further including releasable means of attachment disposed at their ends the beams further including at least two rear guy lines attached substantially near the end of one said beam and crossing diagonally to the opposite end of said parallel beam wherein said x elements are positioned said face to said face, said beams are slidably attached to a plurality of x element strut ends by said releasable means, two adjustable guy lines at the rear of the shelter extend diagonally from one end of said rear beam to the opposite end of the parallel rear beam crossing in both directions and in a plane substantially perpendicular to said cords with length adjusting means used to fix the x element strut rotation, two arms pivotally attached to upper, front x element strut ends, each said arm pivotally attached substantially near one end further including releasable means of attachment disposed at the free end, one or more adjustable elastic cords attached to lower rear x element strut ends, said cords having length adjusting means at one end whereby guy lines compress and hold fast right angle beam ends onto the four, rear x element strut ends, the guy lines cooperate with said cord with length adjusting means of x element struts to selectively lock x elements into various positions, the guy lines provide lateral stability to structure.

16. The portable shelter of claim 15 further including a rectangular, weather moderating cover being substantially the same width of said beams said cover having releasable means of attachment disposed at four corners wherein said cover is releasably attached to free end of said arms by said releasable means, said cover extends over the upper front beam and the upper rear beam and attaches to said elastic cords by said releasable means, whereby the cover is supported in a substantially horizontal position, the front section of the cover can be positioned at various angles to rear portion of cover, tension is maintained on cover by means of said elastic cords.

* * * * *